United States Patent [19]

Else et al.

[11] Patent Number: 4,500,352

[45] Date of Patent: Feb. 19, 1985

[54] PRODUCTION OF CAST IRON

[75] Inventors: George E. Else, Chesterfield; Cyril Millward, Heanor; Ronald H. T. Dixon, Chesterfield, all of England; Knut Jörgensen, Hardanger, Norway

[73] Assignees: Stanton and Staveley Limited, Derbyshire, England; A/S Bjolvefossen, Oslo, Norway

[21] Appl. No.: 554,971

[22] Filed: Nov. 23, 1983

[30] Foreign Application Priority Data

Dec. 1, 1982 [GB] United Kingdom ..... 8234252

[51] Int. Cl.[3] ..... C22C 33/08

[52] U.S. Cl. ..... 75/130 B; 75/53; 75/130 R

[58] Field of Search ..... 266/216; 75/130 R, 130 B, 75/53

[56] References Cited

U.S. PATENT DOCUMENTS

| | | | |
|---|---|---|---|
| 3,598,575 | 8/1971 | Jarysta . | |
| 3,854,939 | 12/1974 | Mezoff | 75/130 B |
| 4,060,407 | 11/1977 | Jackman | 75/130 B |
| 4,299,624 | 11/1981 | Miller | 75/53 |

*Primary Examiner*—Peter D. Rosenberg
*Attorney, Agent, or Firm*—Kinney & Lange

[57] ABSTRACT

The invention provides apparatus for and a method of adding magnesium containing material to molten iron in the production of nodular or modified graphite irons comprising a block of magnesium containing material, and a plunging arm, the block and the arm being shaped such that the block is securely mountable on the arm with the arm projecting into the block substantially to its center of mass.

13 Claims, 1 Drawing Figure

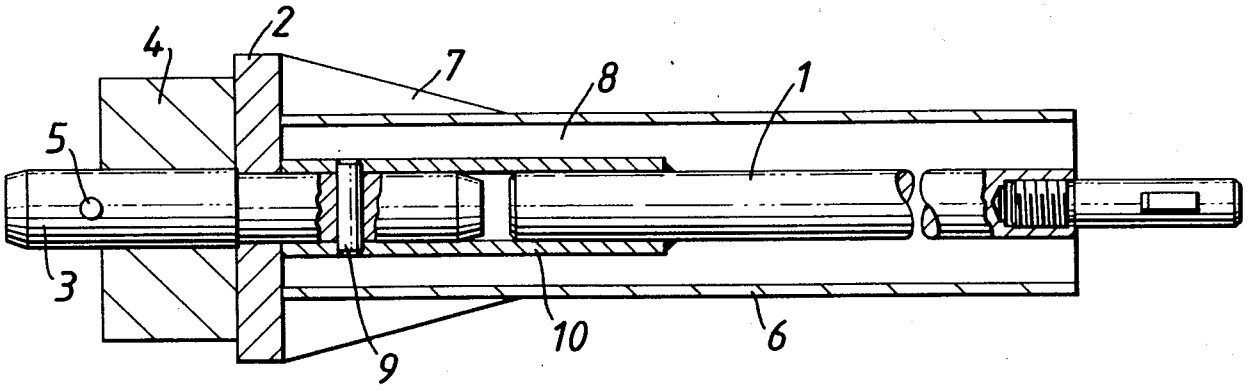
1
2
3
4
5
6
7
8
9
10

PRODUCTION OF CAST IRON

This invention relates to the production of cast iron and more particularly to the production of nodular or spheroidal and other modified graphite cast irons (e.g. compacted graphite cast iron) involving the introduction of a magnesium containing material into a bath or vessel of molten iron.

It has been proposed to produce nodular or spheroidal cast iron by pouring molten metal on to a magnesium alloy, e.g. ferro silicon magnesium, placed in the base of a vessel or ladle. However, this produces a violent and rapid reaction with a resultant relatively poor yield or magnesium recovery.

It has also been proposed to treat the molten metal in a hermetically sealed vessel under air or neutral gas pressure whereby the reaction of the magnesium is controlled and the yield improved. However, this arrangement is commercially disadvantageous because of its intrinsically high process costs and attendant safety problems.

A further proposal involves plunging a magnesium containing alloy to the bottom of a vessel of molten metal by means of an immersion bell. The reaction taking place within the confines of the refractory bell under the prevailing ferrostatic pressure results in the magnesium vapourising and passing through apertures in the bell as vapour bubbles which are then absorbed in the melt. However with this proposal undesirable non-metallic inclusions from the process can be retained and ultimately released from the bell floating to the surface of the metal bath or subsequent baths. This arrangement requires the use of cumbersome and expensive equipment. It is an object of the present invention to overcome or at least substantially reduce the above mentioned disadvantages and problems.

According to one aspect of the present invention there is provided a method of producing nodular or modified graphite irons which includes the steps of containing molten iron in a vessel, and plunging into the molten iron a block of magnesium containing material mounted on a plunging arm projecting into the block substantially to its centre of mass.

According to another aspect of the present invention there is provided apparatus for adding magnesium containing material to molten iron in the production of nodular or modified graphite irons comprising a block of magnesium containing material, and a plunging arm, the block and the arm being shaped such that the block is securely mountable on the arm with the arm projecting into the block substantially to its centre of mass.

The block of magnesium containing material may be formed by pressing casting or moulding for example.

In one embodiment of the invention the block may be formed by compression or compaction techniques similar to those used in powder metallurgy. Thus a powdered or granular combination of metallic magnesium and/or a magnesium alloy together with any other desired addition is homogeneously mixed with a small quantity of a chemical binder or a physical binder, such as, for example, a cellulose material, and then compacted to the desired configuration of the block. The compact may be but is not necessarily sintered. We have found that with a composition including ferro silicon, ferro silicon magnesium and magnesium up to 30% and even 40% the block can have very useful properties of gradual and controlled absorption of the magnesium vapour into the iron such as to form the desired graphite structure. The composition up to this 30% and even 40% level may be of variable quantities of ferro silicon, ferro silicon magnesium and magnesium, but in a preferred embodiment the composition is of 5 to 30 parts ferro silicon and ferro silicon magnesium together with 5 to 10 parts magnesium metal.

The compacted block may have a density within the range of 1.5 to 2.3 gms per cc, and preferably 2.0 to 3.0 gms per cc.

The compacted block may be formed of powder or granules having a grain size within the range of 0.1 to 10.0 mm. The grain size preferably is in the range of 0.5 to 2.0 mm, and in one particular example is in the range 0.5 to 1.25 mm.

The block of magnesium containing material may be centrally mounted upon the shaft and may be in the form of compacted body symmetrical about the shaft. Thus the block may be in the form of an annulus through which the shaft passes.

By choosing the appropriate composition grain size and density it can be ensured that the compacted block is thermally stable and has a relatively low thermal conductivity. We believe that this ensures that no excessively violent reaction of the magnesium occurs on its introduction into the molten metal. We believe this enables the compacted block to overcome problems with cast blocks which can be prone to cracking and disintegration when subject to the high thermal shock occurring during plunging into the molten iron. We have found that compacted blocks can be provided which stay in one piece during use and react progressively from the interface between the block and the molten metal.

With such an arrangement it is possible to control the size and shape of the block in such a manner as to (a) control the rate of reaction, (b) control the strength of the compact as it progressively reacts.

In this way the reacting surface to block volume ratio is controlled for a given type of treatment to achieve optimum performance.

It is possible to provide for control of the reacting surface area of a block. This may be done by coating one or more surfaces of the block in order to control solution rate by altering the surface to volume ratio.

The chemical composition of the block can be chosen so as to enable the provision of a block of adequate size to carry out the necessary processing of the molten iron with one treatment.

We have found that by means of the invention recovery of magnesium is not impaired and that a simple and convenient processing arrangement can be achieved.

The plunging arm may be a disposable unit or may be intended for use many times over in which case it may be protected by refractory material, or it may be partially re-usable but incorporate disposable portions.

In order that the invention may be more readily understood one embodiment thereof will now be described by way of example with reference to the accompanying drawing which illustrates apparatus for adding magnesium containing material to molten iron.

With reference now to the drawing, it is to be observed that a steel arm 1 carries at one end a carbon disc 2 mounted on a carbon rod 3. The rod carries an annular block 4 of ferro silicon magnesium compacted with a binder, the block 4 being held in position by means of a pin passing through a hole 5 in the rod 3. The block may alternatively be held in position on the plunger stem by means of a consumable rod, spring, clip, circlip, clamp or wedge for example.

The arm 1 is attached to carbon rod 3 by means of a ring passing through a ceramic coated steel tube 10 welded to the arm 1 thereby enabling replacement of the carbon rod 3 and disc 2 as their condition deteriorates.

The arm 1 and tube 10 is protected thermally behind the carbon disc 2 by means of a ceramic coated metal tube 6 linked to the disc 2 by a coating 7 of refractory. The annular gap between the arm 1 and tube 10 and the tube 6 is likewise filled with refractory 8. The free end of arm 1 is arranged to be attached to a purpose designed plunging assembly (not shown) by means of which the apparatus may be plunged into a vessel containing molten iron.

We have found that with the apparatus illustrated a compacted block of ferro silicon, ferro silicon magnesium and magnesium can be plunged without violent reaction to near the refractory operating base of the ladle and that the magnesium vapour is released and subsequently absorbed at a regular and even rate from the peripheral surface of the block in contact with the molten iron. Consequently a satisfactory and efficient production of nodular, spheroidal or modified graphite iron can be achieved. What is claimed is:

1. Apparatus for adding magnesium containing material to molten iron in the production of nodular or modified graphite irons commprising a block of magnesium containing material, and a plunging arm, the block and the arm being shaped such that the block is securely mountable on the arm with the arm projecting into the block substantially to its center of mass, the block being formed by mixing a powdered or granular combination of at least metallic magnesium and a magnesium alloy with a binder and compacting to the desired configuration of the block.

2. Apparatus as claimed in claim 1 wherein the plunging arm includes a shaft, and the block is in the form of a body symmetrical about the shaft.

3. Apparatus as claimed in claim 1 wherein the plunging arm includes a shaft, and the block is in the form of an annulus through which the shaft.

4. Apparatus as claimed in claim 1 wherein the plunging arm includes re-usable parts protected by refractory material, and disposable parts.

5. Apparatus as claimed in claim 1 wherein the block is formed by pressing casting or moulding.

6. Apparatus as claimed in claim 1 wherein the block is formed of powder or granules having a grain size within the range of 0.1 to 10.0 mm.

7. Apparatus for adding magnesium containing material to molten iron in the production of nodular or modified graphite irons comprising a block of magnesium containing material, and a plunging arm, the block and arm being shaped such that the block is securely mountable on the arm with the arm projecting into the block substantially to its center of mass, wherein the block has a composition including ferro silicon, ferro silicon magnesium and magnesium up to 40%.

8. Apparatus as claimed in claim 7 wherein the block has a composition including ferro silicon, ferro silicon magnesium and magnesium up to 30%.

9. Apparatus as claimed in claim 8 wherein the composition is of 5 to 30 parts ferro silicon and ferro silicon magnesium together with 5 to 10 parts magnesium metal.

10. Apparatus as claimed in claim 7 wherein the block has a density within the range of 1.5 to 2.3 gms per cc.

11. A method of producing nodular or modified graphite irons including the steps of containing molten iron in a vessel, forming a block of magnesium containing material by mixing a powdered or granular combination of at least metallic magnesium and a magnesium alloy with a binder and compacting to a desired configuration, mounting the block of magnesium containing material mounted on a plunging arm projecting into the block substantially to its center of mass, and plunging the block into the molten iron.

12. A method as claimed in claim 11 wherein the arm includes a shaft, and the block is in the form of a body symmetrical about the shaft through which the shaft passes.

13. A method of producing nodular or modified graphite irons including the steps of containing molten iron in a vessel, and plunging into the molten iron a block having a composition including ferro silicon, ferro silicon magnesium and magnesium up to 40%, the block being mounted on a plunging arm projecting into the block substantially to its center of mass.

* * * * *